US006688025B1

(12) United States Patent
Cullinan

(10) Patent No.: US 6,688,025 B1
(45) Date of Patent: Feb. 10, 2004

(54) MENU SYSTEM

(75) Inventor: James E. Cullinan, 2737 Welsford Rd., Columbus, OH (US) 43221

(73) Assignee: James E. Cullinan, Columbus, OH (US)

( * ) Notice: Subject to any disclaimer, the term of this patent is extended or adjusted under 35 U.S.C. 154(b) by 0 days.

(21) Appl. No.: 10/158,698

(22) Filed: May 30, 2002

Related U.S. Application Data

(60) Provisional application No. 60/295,076, filed on May 31, 2001.

(51) Int. Cl.[7] ..... G09F 13/04
(52) U.S. Cl. ..... 40/568; 40/534; 40/575
(58) Field of Search ..... 40/568, 574, 575, 40/576, 564, 620

(56) References Cited

U.S. PATENT DOCUMENTS 3,905,139 A 9/1975 Cooper ..... 40/64 R
4,292,752 A * 10/1981 Clark ..... 40/576
4,682,430 A * 7/1987 Ramsay ..... 40/576
4,817,316 A * 4/1989 Walker ..... 40/576
4,977,698 A * 12/1990 Seggerson ..... 40/576
4,991,334 A 2/1991 Amundsen ..... 40/568
5,088,221 A * 2/1992 Bussiere et al. ..... 40/576
5,457,615 A 10/1995 Nezer ..... 362/223
5,588,238 A 12/1996 Visocky et al. ..... 40/618
5,901,486 A * 5/1999 Sharon et al. ..... 40/568
6,282,825 B1 9/2001 Godfrey et al. ..... 40/611

* cited by examiner

*Primary Examiner*—Gary Hoge
(74) *Attorney, Agent, or Firm*—Kremblas, Foster, Phillips & Pollick

(57) ABSTRACT

A menu system comprises a frame that receives interchangeable menu sections of a width such that sections of various width are combined to fill the frame space. The menu sections have a central section with upper and lower front channels that receive backing strips, copy strips, and digital price carriers. The central section may also have upper and lower rear channels, an upward extending light blocking projection, and a central aperture for back lighting. A clip may be used in the front or rear upper and lower channels to secure the menu sections to the frame.

9 Claims, 7 Drawing Sheets

MENU SYSTEM

CROSS REFERENCE TO RELATED APPLICATION

This application claims the benefit of U.S. Provisional Application 60/295,076 filed on May 31, 2001, all of which is incorporated here by reference as if completely written herein.

BACKGROUND OF THE INVENTION

1. Field of the Invention

This invention pertains to menu systems that typically convey item availability and pricing schedules such as those often used in fast food establishments. More specifically this invention relates to a menu system that provides a menu with an interchangeable set of display carriages of various widths.

2. Background of the Invention

In one of its most basic forms, a menu consists of a single piece of sheet material on which items and prices are indicated. Some of the most simple menu systems consist of a chalk board or piece of poster board on which available items and their prices are handwritten on the board, e.g., hamburgers $1.95, fries, $0.99, and so forth. Although such sign systems are often associated with restaurant type displays, it is to be realized that such sign systems are used in a wide variety of industries and although the present invention is illustrated with restaurant-type sign systems, it is to be realized that the present invention is not limited to the restaurant industry.

With the advent of fast-food chains the graphics quality and display have improved considerably. Currently such establishments have back lit sign systems with a menu face of professionally created graphics and some flexibility as to specific items offered and price. Typically the menu face is a rigid sheet of clear plastic on which "permanent" graphics such as the establishment name and logo are permanently configured. "H tracks" are then permanently affixed to the menu face at a predetermined spacing to accept copy strips, backup strips, and price carriers inserted into opposing H-track channels mounted on the menu face with adhesive. In such an arrangement, the graphics and H tracks are a permanent feature of the plastic menu face. Only the copy and backup strips and the digits in the price carriers can be changed. In menu board designs, the H-tracks are applied in a semi-permanent fashion which allows their removal and re-application. However this tends to be a slow and tedious process and subjects the plastic menu face to marring and disfiguration if the adhesive is not completely removed.

Typically the plastic menu face is inserted in a frame. For indoor use, the frame and menu face is then hung over a back light box with an appropriate hanger on the frame, e.g., an inverted channel that fits on an upward extending lip of a back lighting box. For outdoor use, the frame is placed into a recessed ledge formed at the front of a back lighting box. Typically outdoor signs have a transparent sheet that covers the frame and menu face to protect it from weather and vandalism. This is often formed as a door with a transparent sheet that is hinged to the back lighting box and closed and locked over a frame and menu face that has been placed into the recessed ledge of the backlighting box.

In any event, current menu systems tend to be expensive in that they require a complete new menu face whenever new graphics, logos, or messages are desired. For example, when it is desirable to feature a new item on a menu with prominent graphics, a complete transparent menu sheet (menu face) most be prepared with all new graphics, lettering, and H-strip layout. Similarly, all new menu faces must be prepared whenever an establishment wishes to feature a summer menu, a holiday menu, menus for other specialty and seasonal items. Needless to say, major menu changes can be quite costly, especially for regional and national chains which may be required to replace thousands of menus on a seasonal and holiday basis.

To meet the problems and shortcomings of the present menu systems, it is an object of the present invention to produce a menu system of high flexibility.

It is another object of the present invention to provide a menu face of completely interchangeable sections.

It is another object of the present invention to provide a menu that allows for interchangeable menu sections.

It is another object of the present invention to provide a menu that has menu sections of interchangeable size.

It is an object of the present invention to provide a menu face that allows for placement of menu line items in any position on the menu face.

It is an object of the present invention to reduce the amount of disassembly of menu board parts in changing the menu design.

Yet another object of the present invention is to provide a clip that holds each section of the menu firmly in place within the frame.

A further object of the present invention is to provide a retainer that holds all sections of the menu face firmly in position within the menu frame.

It is another object of the present invention to provide an interlocking menu section design that prevents light from coming through the slits between sections of the menu face.

The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

SUMMARY

In order to meet these objects, the menu system of the present invention features a frame have opposite parallel sides, a top and bottom that define a frame space and interchangeable menu sections of a widths such that the menu sections are selected to fill the frame space. This has of advantage of allowing sections of various widths to be placed at any location within the frame. Thus a large width advertizing menu section may be placed at the top of the frame, an intermediate width menu section with "specials" place below the large width menu section, and narrow width menu sections used at the bottom for menu items and pricing.

The interchangeable menu sections comprising a vertical central portion, a bottom portion that projects outward (frontward) from the bottom of the central portion at essentially a right angle to the central portion, and a top portion that projects outward (frontward) from the central portion at essentially a right angle to the central portion. A bottom front end projects upward at a right angle from the distal end of the bottom portion to form a lower front channel. Similarly, a top front end projects downward from the distal end of the top portion to form an upper front channel.

The upper and lower front channels receive backing strips, copy strips, and digit price carriers. An aperture can be formed in the central portion for the purpose of illuminating the copy strips when a rear lighting box is used.

In addition to the upper and lower front channels, similar upper and lower rear channels may also be formed on the central portion by extending the top and bottom portions backward and then downward and upward, respectively. The top backward portion may have an upward projection which has the advantage of effectively blocking back lighting from passing between the interchangeable menu sections. However, it is to be realized that back lighting is not essential and that side or front lighting devices may also be used.

Clips may be used in either the front or rear upward and lower channels to secure the menu sections to the frame.

Figure 1:
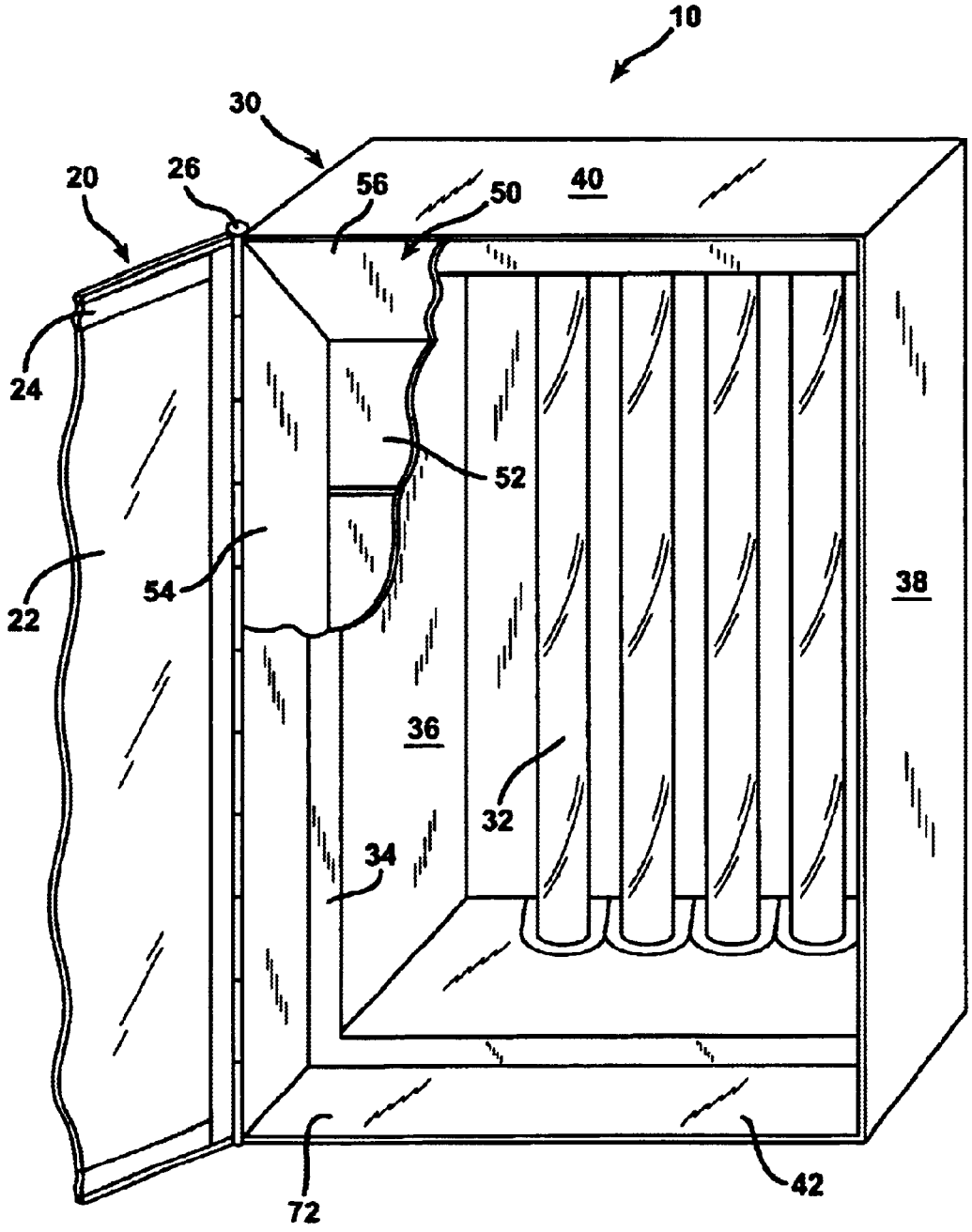
FIG. 1 is a perspective view of a sign system illustrating the components of a typical sign system for outdoor use including the back lite box, a broken away portion of the menu face and frame, and a transparent and protective covering door.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF THE INVENTION AND BEST MODE FOR CARRYING OUT THE PREFERRED EMBODIMENT

With reference to the drawings and initially FIG. 1, a sign system 10 is shown for outdoor use. Sign system 10 comprises an enclosure 30 containing backlighting 32 for menu system 50 which comprises a menu face 52 and frame 54. The outer perimeter of menu system 50 conforms to the inner perimeter 72 of enclosure 30 and is sized to allow for easy insertion and removal from enclosure 30. A flange 34 fastened to the interior of sides 36, the top 40, and bottom 42 positions the menu system 50 at the open front of enclosure 30 and prevents light from shining through the slight spacing between the outer perimeter 56 of menu frame 54 and the inner perimeter of enclosure 30. For outdoor use, a door 20 having a frame 24 and transparent sheet material 22 is hinged to side 36 with hinge 26 and closes over the menu system 50 to protect it from weather and vandalism. A locking mechanism (not shown) is typically used to secure door 20 in a closed position.

Figure 2:
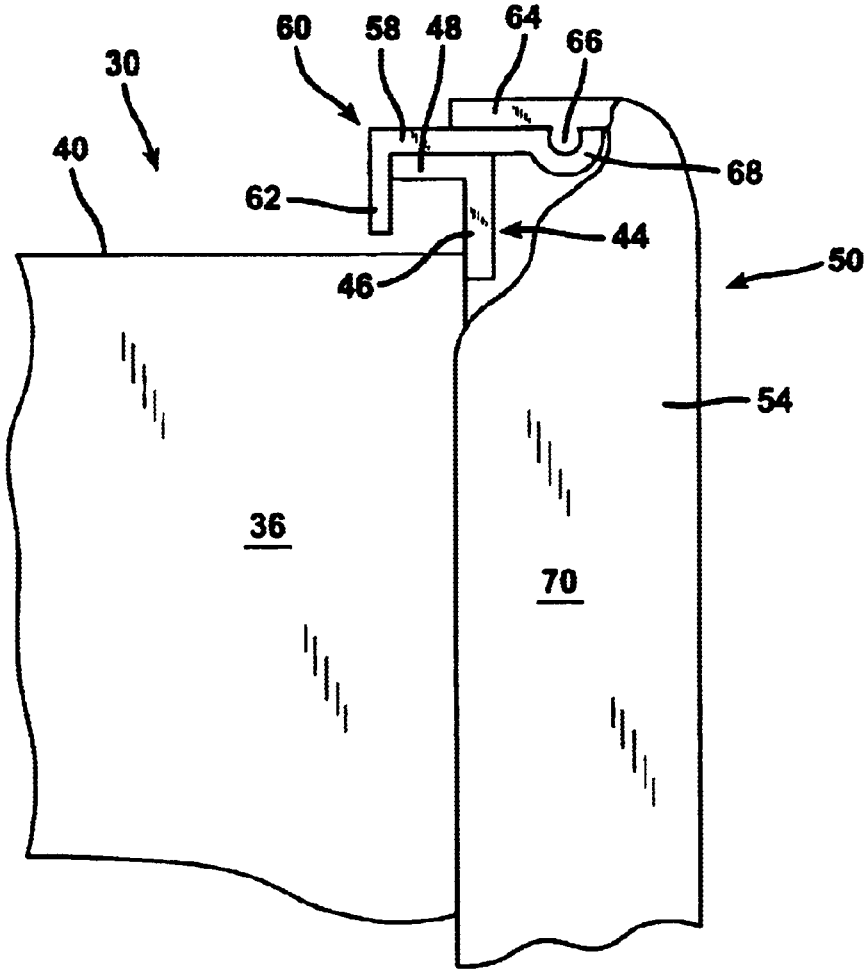
FIG. 2 is a partial side elevational view illustrating a hanger assembly by which the menu frame is secured to the back lighting enclosure 30 for indoor use.

For indoor sign systems 10 and as shown in FIG. 2, the menu system 50 can be hung on enclosure hook 44. Hook 44 comprises an upward projecting member 46 attached to the front edge of the top 40 of enclosure 30. Member 46 bends to the back of enclosure 30 in an end portion 48 that is essentially parallel to the top 40 of enclosure 30. Frame hanger 60 is attached to the top of frame 50 by means of a rod and socket assembly. A rounded rod shaped projection 66 extends downward from the inside of the top portion 64 of frame 54. Rounded projection 66 extends completely around the interior perimeter of frame 54 and meets at the corners of frame 54 in mitered fashion. Hanger 60 has an oblong socket 68 formed in a first end of central piece 58 that opens upward, engages and is secured by rod-shaped projection 66. The opposite end 62 of central piece 58 projects downward at right angles to the remaining portion of hanger 60. The top portion 64 of frame 54 prevents hanger 60 from rotating beyond a horizontal position. Downward projection 62 extends downward over horizontal end 48 of hook 44 and secures the menu system 50 to enclosure 30. Hanger 60 is of such length that the sides 70 and bottom of frame 54 extend slightly beyond the front of enclosure 30 so as to cover any opening between frame 54 and enclosure 30 that would allow the escape of light.

FIGS. 3–6 illustrate a conventional menu face 200 currently in use. Menu face 200 consists of a single sheet of material 206 on which various graphics and lettering are permanently printed. H-strips (see FIG. 4) are also attached to sheet material 200 at predetermined spacing to accept various backing strips 250 (FIG. 5), 256 (FIG. 6); copy strips 252, 258, and a digit carrier 220. Although not shown in FIG. 3, the spacing between H-tracks can be varied to accept strips of various width. Thus a menu board could include a wider header strip with the heading "Beverages" with narrow strips below it with narrower individual beverage strips.

Figure 7:
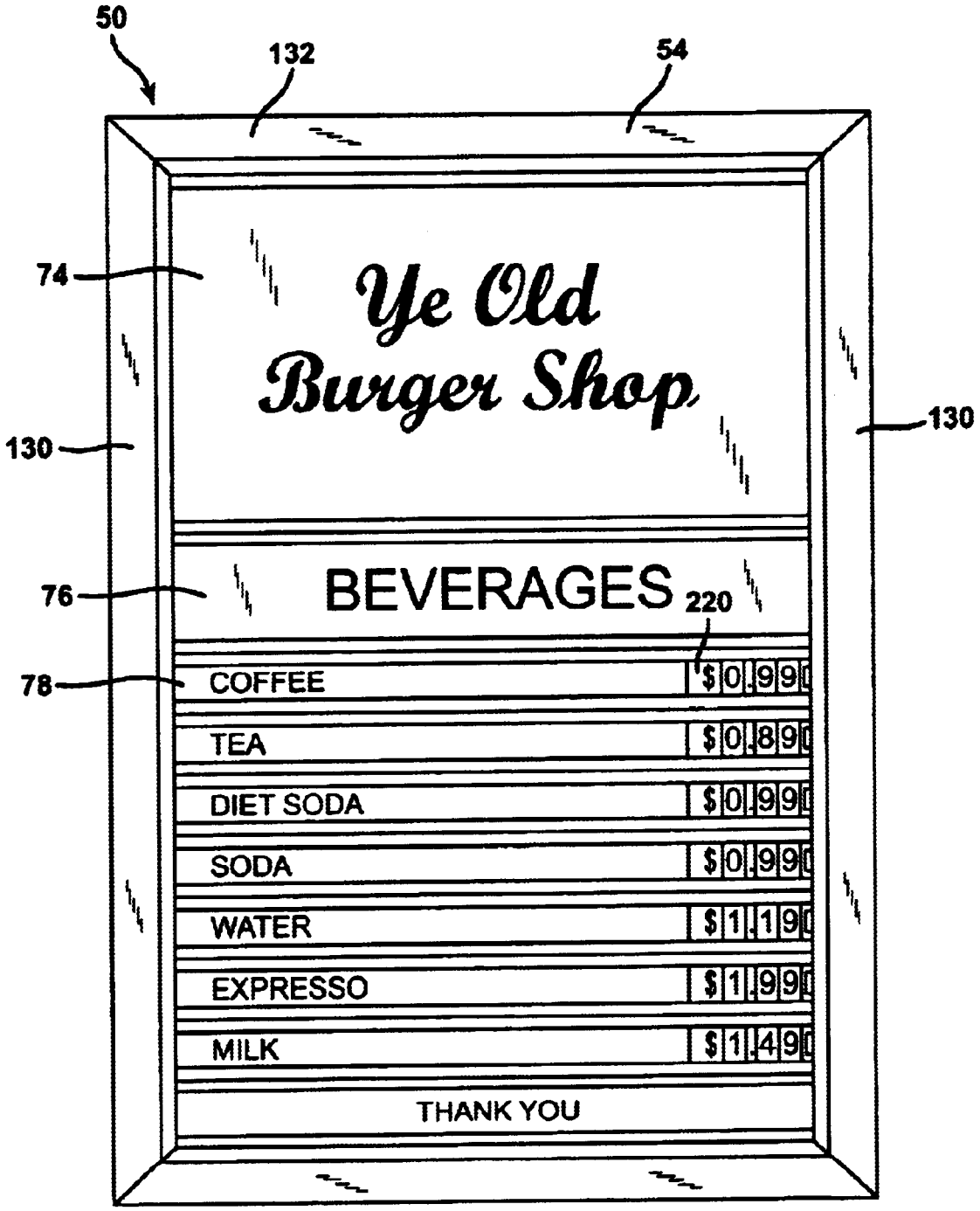
FIG. 7 is a front view that illustrates the frame and separate menu sections of the current invention.

FIG. 7 illustrates the menu system 50 according to the present invention. It consists of a mitered frame 54 and consists of individual, interchangeable menu sections 74, 76, and 78. As shown, section 74 is a wide menu section, 76 is a menu section of intermediate width, and section 78 is a menu section of narrow width. Preferably the menu sections are in widths that are multiple units of each other. Thus if section 78 is 1 unit wide, then section 76 is 2 units wide and section 74 is 6 units wide. Because each of the units are separate and interchangeable, a wide variety of signs can be created with the menu system 50 of the present invention. For example, if the total space is 16 units, one could form a sign with two wide units 74 (a total of 12 units) and four narrow units 78 (total of 4 units) to fill the available space. Another arrangement might have two wide units 74, an intermediate unit 76, and two small units 78. As becomes apparent a wide variety of arrangements can be created using menu sections of various widths placed in various positions within the total frame space.

Figure 8:
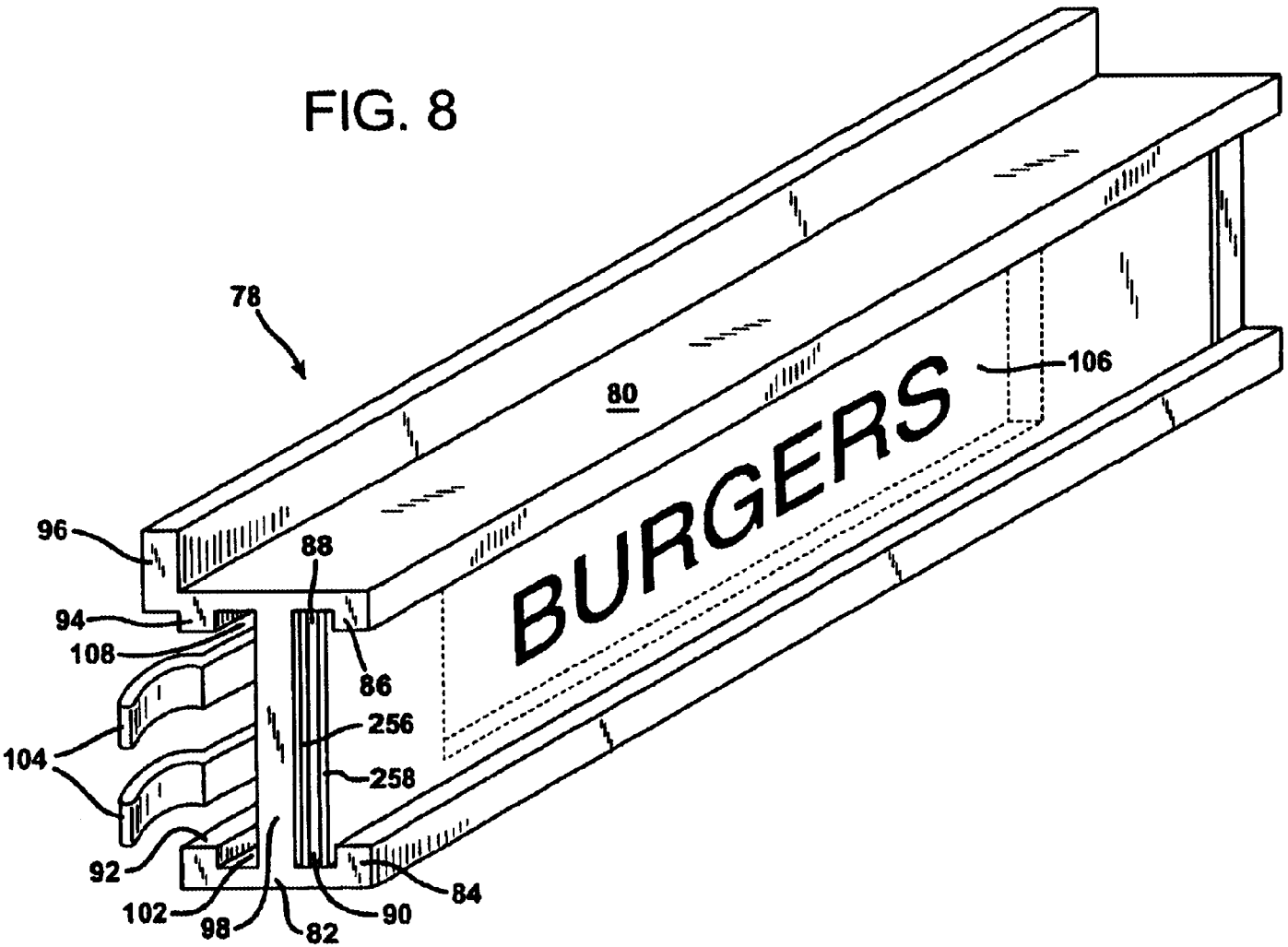
FIG. 8 is a perspective view of a narrow menu section of the current invention.

FIG. 8 illustrates a narrow menu unit 78 although it is to be realized that typically the only difference between the various menu units 74, 76, and 78 is the width (height) of the unit. Menu unit 78 is an I-beam type configuration having a central portion 98 and a top portion 80 and a bottom portion 82 attached at right angles to central portion 98. The rear end 92 and the front end 84 of bottom portion 82 turn upward (parallel) to the central portion 98 to form lower front and rear channels 90 and 102, respectively. The front end portion 86 of upper portion 80 of the I-beam configuration turns downward (parallel) to the central portion to form an upper front channel 88. Upper and lower channels 88 and 90 can accept standard backing and copy strips 256 and 258, respectively, that are currently used in conventional menu systems when the cental portion 98 is sized to the correct width. A digit carrier (FIGS. 3 and 6) may also be inserted in the upper and lower channels 88 and 90 (not shown in FIG. 8). An aperture 106 formed in the central portion 98 of the I-beam configuration allows for backlighting of the backing and copy strips, 256 and 258.

The upper portion 80 of the I-beam type configuration bends upward (parallel to main section 98) in upward projection 96 which blocks light from passing through any spaces that might exist between individual menu sections 74, 76, and 78. A downward projection 94 from the rear, upper portion 80 forms, with central portion 98 and upper portion 80, channel 108. Rear upper and lower channels 108 and 102, respectively, accept a snap clip 120 (FIG. 9) which holds each menu section in menu frame 54. Lock fingers 104 of snap clip 120 are shown projecting from the left side of menu section 78. The top of upper portion 80 between the upward projection 96 and the front edge of the top of upper portion is the same width as the base of bottom section 82 and allows stacking of the menu sections 74, 76, and 78, one on top of another, within the menu frame 54.

Figure 9:
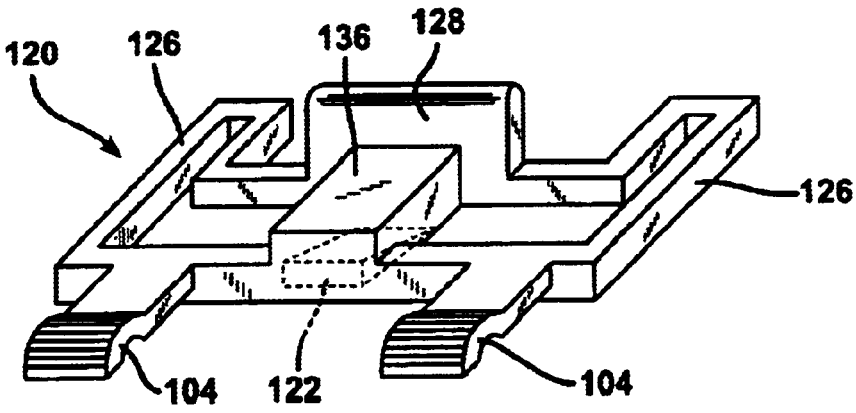
FIG. 9 is a perspective view of a clip according to the present invention for securing menu sections to the side frame members.
Figure 3:
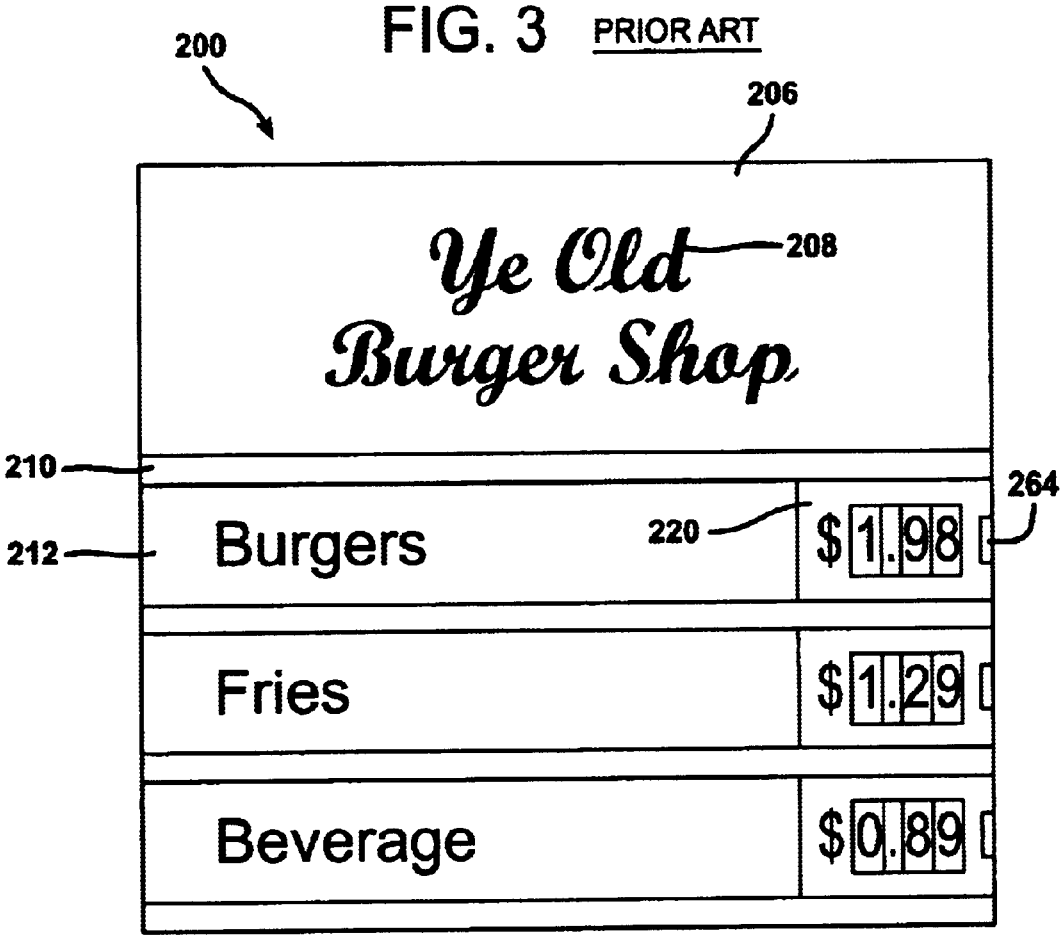
FIG. 3 PRIOR ART
FIG. 3 is a front elevational view illustrating a one sheet menu face using attached H-tracks for backing and copy strips and price digit carriers.
Figure 4:
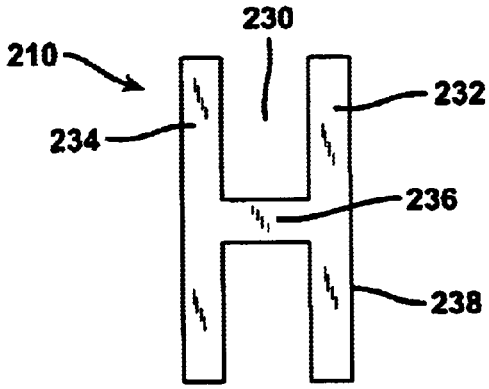
FIG. 4 PRIOR ART
FIG. 4 is a side view of a typical H-track used with a one sheet menu face.
Figure 5:
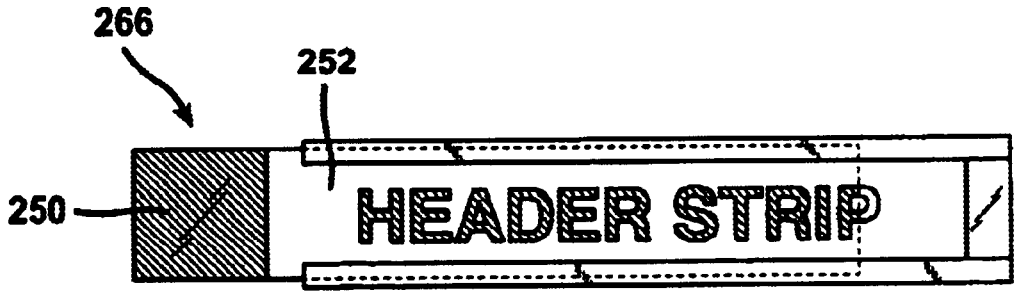
FIG. 5 PRIOR ART
FIG. 5 is a front view that illustrates a backing and a copy strip as used with the H-tracks to form a header strip.
Figure 6:
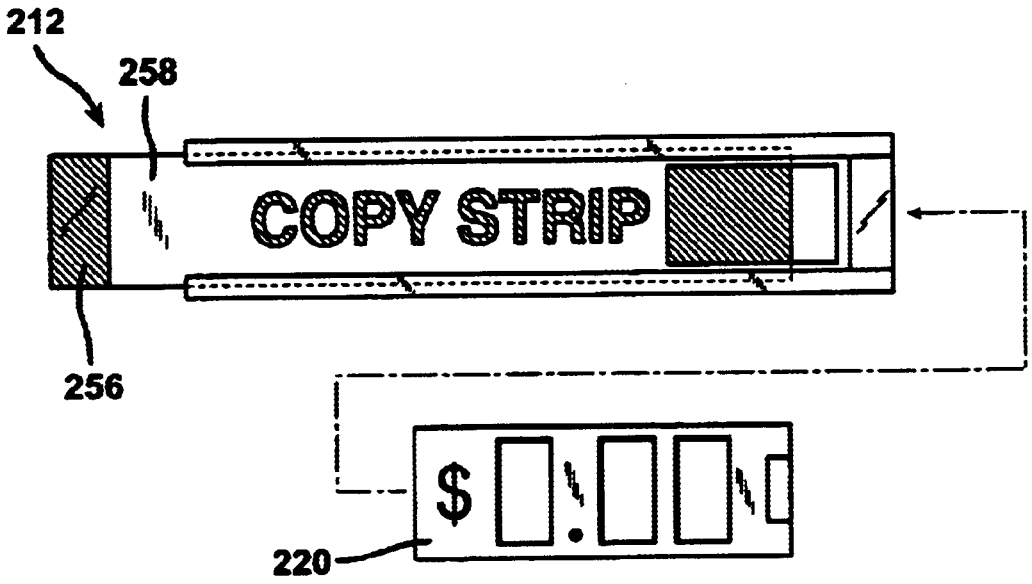
FIG. 6 PRIOR ART
FIG. 6 is a front view that illustrates backing and copy strips and a digit price carrier used for specific menu items.
Figure 10:
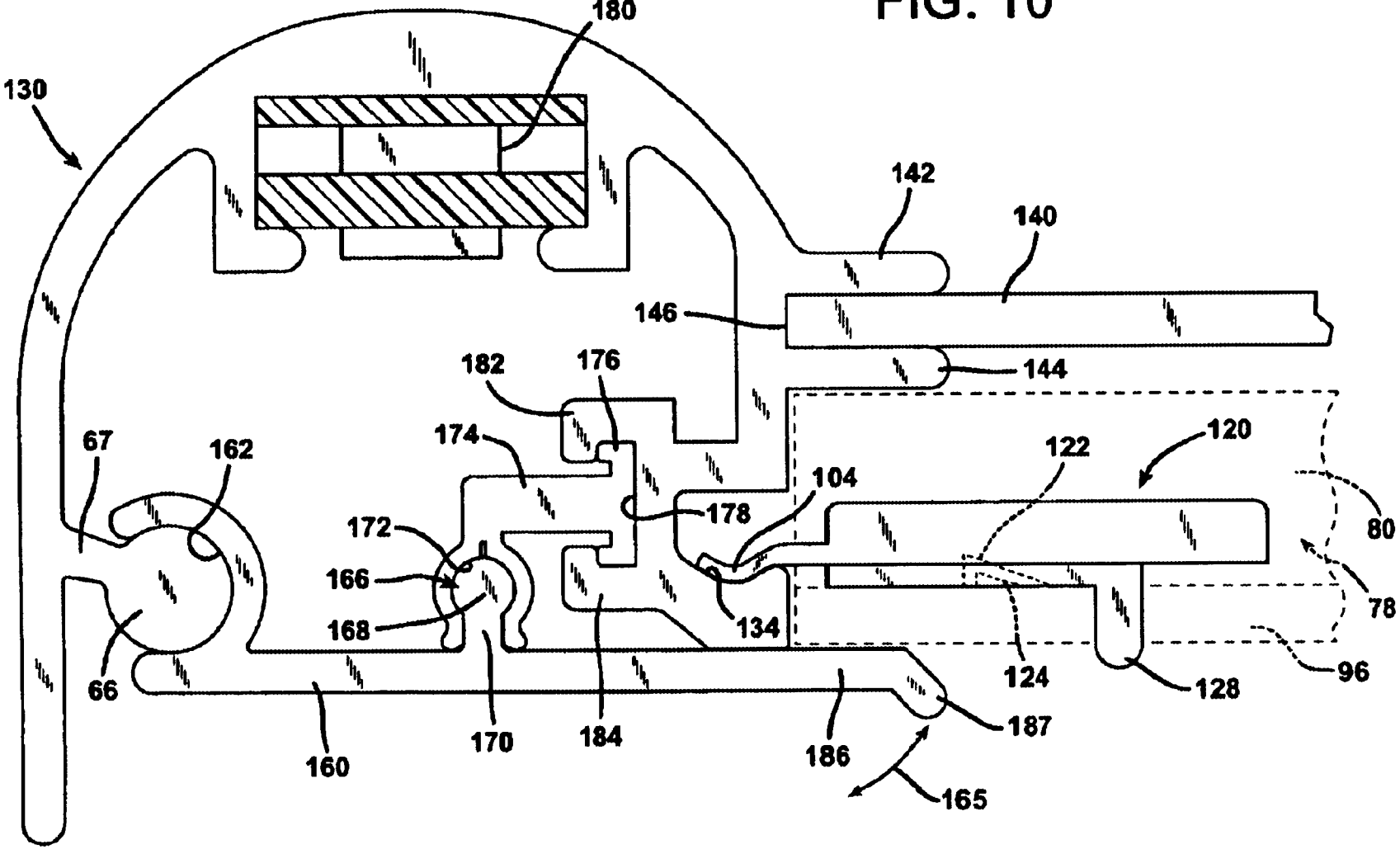
FIG. 10 is a top view of a side frame member that illustrates the use of the clip to secure individual menu sections to the frame including a projection and recess for locking the clips to the menu section and a menu strip retainer for retaining all of the menu sections within the menu frame.

FIG. 9 illustrates a clip 120 that retains the menu sections within the menu frame 54. Clip 120 has a central portion 136 from which two fingers 104 project. Legs 126 are attached to central portion 136 and ride in channels 102 and 108 of the one of the menu sections 74, 76, and 78 (FIG. 8). A handle projection 128 is used to move the clip 120 in the channels 102 and 108 and lock and unlock it from the side frame members 130. As shown in FIG. 10, clip 120 is moved toward the frame member 130 until fingers 104 engage a recess 134 formed in frame member 130. A small projection 124 (shown in phantom) on the rear side of central portion engages a recess 122 formed in clip 120 to firmly lock the menu section (74, 76, or 78) in place with the frame 54.

FIG. 10 is a top view of the right frame member 130 as viewed in FIG. 7 with the top frame member 132 removed. Inward directed frame projections 142 and 144 form a channel 146 which secures a transparent cover sheet 140 that covers the face of the menu sections 74, 76 and 78. The menu frame 54 is loaded by placing the frame face down. Each menu section is then placed in the frame and rests on the back side of projection 144. In FIG. 10 frame section 78 is shown in phantom with the front edge in position against the rear of projection 144. Once the frame section is in place, clips 120 at each end of frame section 78 are slide outward in channels 102 and 108 until projecting fingers 104 engage the recess 134 in the right and left frame members 130. At the same time, clip 120 rides up over projection 124 on the rear of central portion 98 of the menu section 78 until projection 124 engages recess 122 formed in the central portion 136 of clip 120.

As shown in FIG. 10, the present invention also features a menu strip retainer 160 that maintains all of the menu sections 74, 76, and/or 78 in place within the menu frame 54. The menu strip retainer 160 has a socket 162 formed at one end which engages the rod-shaped projection 66 at the end of post 67 which projects inward from the outer edge of frame member 130. Menu strip retainer 160 rotates around rod-shaped projection 66 as shown by arrow 165. A rod and mounting post projection 166 comprises a terminal rod 168 mounted on oblong projection 170 which extends from the mid-portion of menu strip retainer 160. Rod 166 engages socket 172 which is at a right angle to the first end of central piece 174. The opposite end of central piece 174 is formed as a base member 176 whose ends firmly engage a slot 178 formed by fingers 182 and 184 that project outward from the interior side of frame member 130. After all of the menu sections 74, 76, and 78 have been loaded into the menu frame 54 against projection 144 and the clips slide into place, the menu strip retainer 160 is rotated about rod projection 66 until rod projection 166 engages and is held in place by socket 172. The end portion 187 of retainer portion 160 opposite socket portion 162 engages the back side of upward projecting sections 96 (shown in phantom in FIG. 10) and holds all of the menu sections 74, 76, and 78 securely in place. The far end of retain 160 is bent outward for ease moving retainer 160 to the open position. Corner clip 180 is conventional and holds the extruded frame members together at their mitered corners.

It is possible that changes in configurations to other than those shown could be used but that which is shown is preferred and typical. Without departing from the spirit of this invention, various means of fastening the components together may be used.

It is therefore understood that although the present invention has been specifically disclosed with the preferred embodiment and examples, modifications to the design concerning sizing and shape will be apparent to those skilled in the art and such modifications and variations are considered to be equivalent to and within the scope of the disclosed invention and the appended claims.

It is possible that changes in configurations to other than those shown could be used but that which is shown is preferred and typical. Without departing from the spirit of this invention, various means of fastening the components together may be used.

What is claimed is:

1. A menu system comprising a) a frame have opposite parallel sides, a top and bottom defining a frame space;

b) interchangeable menu sections of a width such that said menu sections fill said frame space; and c) said interchangeable menu sections comprising:

1) a central portion, 2) a bottom portion projecting outward from said central portion at a bottom edge thereof at essentially a right angle to said central portion;

3) a top portion projecting outward from said central portion at a top edge thereof at essentially a right angle to said central portion;

4) a bottom front end projecting upward from said bottom portion to form a lower front channel; and 5) a top front end projecting downward from said top portion to form an upper front channel.

2. The menu system according to claim 1 wherein said lower front channel and said upper front channel receive a backing strip.

3. The menu system according to claim 1 wherein said lower front channel and said upper front channel receive a copy strip.

4. The menu system according to claim 1 wherein said lower front channel and said upper front channel receive a digit carrier.

5. The menu system according to claim 1 wherein said lower front channel and said upper front channel receive a moveable clip for fastening said menu section to said sides of said frame.

6. The menu system according to claim 1 further comprising a aperture formed in said central portion.

7. The menu system according to claim 1 wherein said top portion also projects backward and then upward to form a light blocking upward projection.

8. The menu system according to claim 7 further comprising:

a) a downward projection, said downward projection, said backward projection of said top portion, and said central portion forming an upper rear channel; and b) a backward projection of said bottom portion;

c) an projection extending upward from said backward projection of said bottom portion with said backward projection of said bottom portion, said projection extending upward from said backward projection, and said central portion forming a lower rear channel.

9. The menu system according to claim 1 wherein said wherein said lower rear channel and said upper rear channel receive a moveable clip for fastening said menu section to said sides of said frame.

* * * * *